United States Patent [19]

Rausing et al.

[11] Patent Number: 4,601,692

[45] Date of Patent: Jul. 22, 1986

[54] METHOD AND APPARATUS FOR THE MANUFACTURE OF PAPER SHEETS HAVING DECORATIVE EDGES

[75] Inventors: Hans Rausing, Wadhurst, Great Britain; Ingvar Nilsson, Åkarp, Sweden

[73] Assignee: Suecia Antiqua Limited, London, England

[21] Appl. No.: 655,717

[22] Filed: Sep. 28, 1984

[51] Int. Cl.[4] ..... B26F 3/02; B26D 1/553; D21F 11/00; D21J 1/02

[52] U.S. Cl. ..... 493/355; 493/342; 493/369; 162/194; 225/100; 225/3; 225/93; 225/96; 83/651.1

[58] Field of Search ..... 162/109, 110, 194, 197, 162/286; 493/355, 342, 361, 403, 404, 468, 363, 369, 324, 340; 83/651.1, 856; 225/3, 93, 96, 100

[56] References Cited

U.S. PATENT DOCUMENTS

| | | | |
|---|---|---|---|
| 843,138 | 2/1907 | Dunning | 493/342 |
| 857,133 | 6/1907 | Whitmarsh | 225/93 |
| 1,616,211 | 2/1927 | Armstrong | 162/194 |
| 1,757,204 | 5/1930 | Magill | 162/110 |
| 1,761,051 | 6/1930 | Rivard | 162/194 |
| 1,820,303 | 8/1931 | Dodge | 493/340 |
| 2,026,754 | 1/1936 | Stafford | 225/3 |
| 2,788,852 | 4/1957 | Sharpe | 225/7 |
| 3,666,151 | 5/1972 | Dyer et al. | 225/100 |
| 3,835,754 | 9/1974 | Lewyckyj | 493/363 |

*Primary Examiner*—Francis S. Husar
*Assistant Examiner*—William E. Terrell
*Attorney, Agent, or Firm*—Burns, Doane, Swecker & Mathis

[57] ABSTRACT

A method and apparatus for manufacturing paper sheets having an appearance of being hand-made, the method comprising the steps of forming watermarks on a continuous web along longitudinal and transverse zones spaced according to the width and length of the paper sheets, drying the continuous web, crushing longitudinal and transverse regions of the dried continuous web within the watermarked longitudinal and transverse zones, respectively, tearing and separating the dried continuous web along the longitudinal and transverse crushed regions, respectively.

9 Claims, 4 Drawing Figures

METHOD AND APPARATUS FOR THE MANUFACTURE OF PAPER SHEETS HAVING DECORATIVE EDGES

FIELD OF INVENTION

The present invention relates to a method for the manufacture of a paper web with decorative edge cutting comprising the separation of at least one edge portion of a paper web while at the same time a decorative, irregular edge structure is imparted to the outer lateral edge of the web formed by the separation. The invention relates further to a method for dividing such a web cut along the edge into sheets by severing pieces of sheet from the web while forming a decorative irregular edge cutting transversely to the web.

BACKGROUND OF THE INVENTION

In the manufacture of hand-made paper in the form of sheets a decorative, irregular, outer edge is manually obtained. However, the manufacture of such paper is very expensive and such handmade paper occurs, therefore, only to a very limited extent.

It has been found that paper of the same high, and an even more uniform quality than the existing hand-made paper can be produced by mechanical means, but that the same decorative edge structure is not obtained by this method owing to the mechanical paper being produced in an endless web and not in single sheets.

OBJECT AND SUMMARY OF INVENTION

However, mechanically made paper of high quality with decorative edge cutting can be produced if the cutting is carried out in a special manner and after special premachining of the paper material. A direction concerning such a method is given in the present patent application, which is characterized in that the paper web is compressed in the separating zone by means of cooperating rollers, whereupon the web is conducted over a roller comprising a cutting or tearing device, e.g. a tear wire, knife or cutting wheel, which is located so that it is made to engage with the said compressed region of the web when the same is led over the roller and so that the web, when it is led past the cutting or tearing device, is broken up in its longitudinal direction.

BRIEF DESCRIPTION OF THE DRAWING

A preferred embodiment of the method in accordance with the invention will be described in the following discussion with reference to the enclosed schematic drawing, wherein.

DETAILED DESCRIPTION OF THE PREFERRED EMBODIMENT

The manufacture of the web or sheet in accordance with the invention is started already during the paper making, where the paper stock in the normal manner is poured onto an endless wire screen. In a known manner so-called watermarks can be obtained in a paper by treating the paper pulp on the screen with a so-called dandy roller. This dandy roller consists of a cylinder clad with a screenlike wire netting. In this wire netting is inlaid a pattern of other wires which on the one hand project a little outside the surface of the wire cylinder and on the other hand reduce the mesh width on the net-clad cylinder. Along the region where additional wires have been inserted so-called watermarks are formed if the dandy roller is made to rotate with the screen and in so doing has its surface in the paper pulp. It is possible in this manner to form longitudinal and transverse zones or edges which form watermarks in the finished paper. It is ensured of course that the width between the "watermark edges" of the dandy roller becomes the desired width of the final web or sheet, and that the distance between the transverse watermark edges will correspond to the desired length of the sheets in the case where the web is intended to be divided up into individual sheets.

Figure 4:
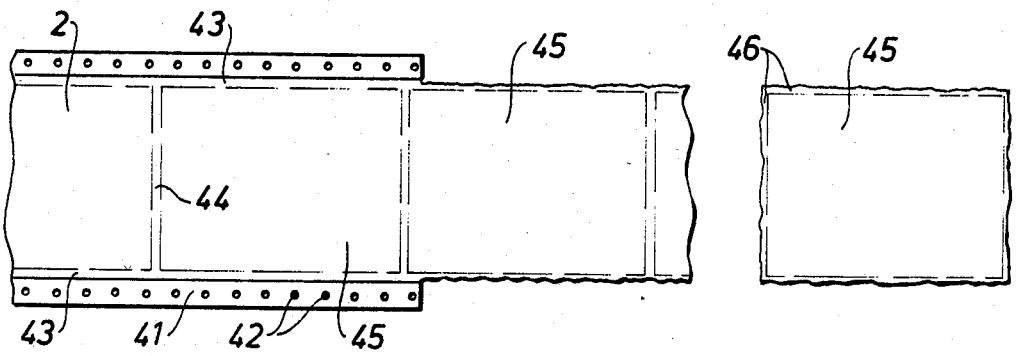
FIG. 4 is a schematic view of the web in its different phases during the cutting into sheets.

After drying of the paper web holes 42 may be made in the edge portions 41 of the web 2 for the guiding and feeding of the paper web e.g. into a data printer. As is evident from FIG. 4, the web 2 is provided with longitudinal watermark lines 43 and transverse watermark lines 44 which jointly delimit the sheet 45 which is to be produced, this sheet having a decorative, irregular edge zone 46 in the said watermark zones 44 and 43. This combination of a watermark zone around the edge of the sheet 45 in conjunction with the irregular edge cutting and the otherwise high quality of the paper give the impression of the paper having been hand-made.

Figure 1:
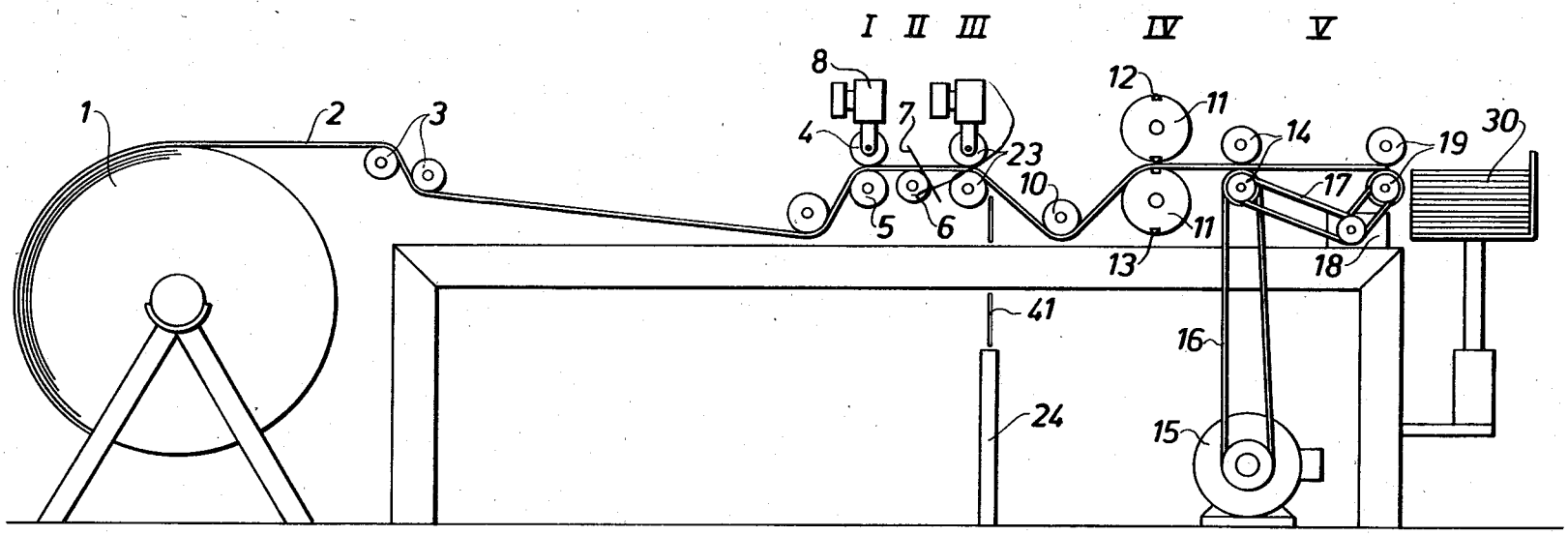
FIG. 1 is a side view of an arrangement for the edge and sheet cutting of a paper web, in accordance with the present invention
Figure 2:
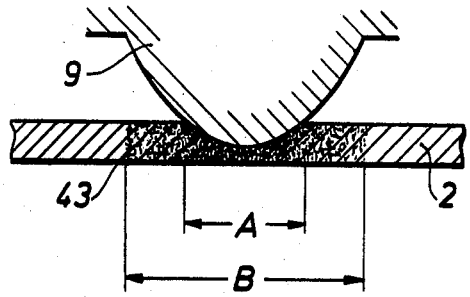
FIG. 2 is a detail view in cross-section of the arrangement for compression of the paper web.

Thus the paper web 2 is made in the normal manner but is provided with at least longitudinal watermark lines 43 and, if the web is to be converted to sheets, also with transverse watermark lines 44. The said paper web produced is rolled onto a magazine roll 1 which is shown in FIG. 1, and the web 2 is led over the deflection rollers 3 to be conducted subsequently to the treatment station I where the web in the longitudinal watermark zones 43 is subjected to a compression with the help of a tool which is arranged on a roller 4 and which operates against a plain hold-on or counter-pressure roller 5. On the tool roller 4, which can be pressed against the hold-on or counter-pressure roller 5 with the help of a spring or an air cylinder 8, a tool is arranged, the working surface of which has a profile 9 as shown in FIG. 2. The compression tool 9 is thus of a convex shape and preferably a V-shape with rounded front surface and when the web 2 is conducted between the rollers 5 and 4 the tool 9 will be pressed into the web 2, and since the tool 9 is arranged around the periphery of the web 4 the tool 9 will during the rolling movement continuously compress a zone A of the web 2 while the web is conducted past the roller pair 4 and 5. Owing to the particular shape of the tool 9 the compression will be greatest at the front part of the tool 9 and diminish then towards the edges of the compression zone A. The compressed zone can be made of any width, but in the present case the width of the compressed zone is 1–5 mm. As is evident from FIG. 2, the compressed zone A is located within the zone B which represents the zones 43 with the longitudinal watermark edges. The tool 9 is thus brought into engagement with the web 2 along the longitudinal watermark zones 43 and is guided so that during the whole time the compression zone is inside the watermark zone 43. Since the web 2 has two watermark zones 43, the roller 4 is provided with two annular tools arranged around the periphery of the roller which are adapted so that they both operate within the watermark edge zones 43, and the pressure with which the tool 9 is pressed against the web 2 can be regulated with the help of springs or air cylinders 8. The tool 9 is preferably made of steel and the plain hold-on roller 5 too is preferably made of steel. The web treated in this manner in station I is conducted to station II which comprises a rotating roller 6, this roller being provided with grooves 20 which are arranged at such a distance from each other that their mutual position corresponds to the compressed watermark zones 43. The station II, moreover, comprises a cutting arrangement 7 which consists of a stationary wire 21, preferably of metal, which is clamped between clamping points 22 fixed to the frame of machine.

Figure 3:
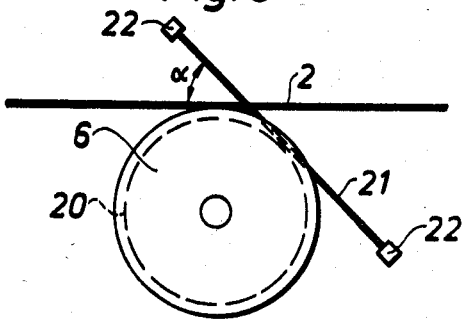
FIG. 3 is a detail view of an arrangement for the cutting of the longitudinal edges.

As is evident from FIG. 3, the wire 21 is clamped in such a manner that it is inclined in respect of the web and forms an acute angle alpha with the web. The wire 21 is located so that it lies in the groove 20 preferably without resting against the roller 6. The wires 21 are preferably adjusted so in their position that they correspond to the position of the compressed zone A on the watermark edges 43.

When the web 2 is led over the roller 6 the tearing wires 21 will tear up the material web 2 along the compressed parts of the watermark edge zones 43, the outer edges being separated whilst the tearing edge obtains a somewhat irregular edge structure.

In the station III the separated edge zone 46 is machined again by two co-operating clamp rollers which are pressed against each other in the edge zone, any portions of the edge zone which may have "napped up" being pressed together. The web 2 is led over the deflection roller 10 up to the station IV where two co-operating and controlled clamp rollers compress the transverse watermark zones 44. This compression is carried out with linear pressing tools which are arranged axially to the surface of the clamp rollers 12, and the compression of the transverse watermark zones 44 is carried out in such a manner that the paper web is not completely severed but is substantially weakened in as much as the paper fibres are crushed. It is also possible to arrange on the rollers 12 hinged clippers for the severing of the paper sheets, but in this case it is not possible to achieve the same attractive edge structure as when the paper fibres are crushed and the sheets 45 are subsequently separated from the web 2 by pulling until the weakened watermark zone is caused to break. The cylinders 11 in the station IV have to be controlled so that the tools will engage at the right place, that is to say within the watermark edge 44 and this can be done e.g. by means of a photocell control. This control functions so that a photocell indicates the position of the watermark zone 44 which is more transparent than the surrounding portions, whereupon a signal is transmitted to the driving unit for the pair of rollers so that the tools 12, 13 will engage with the paper web 2 precisely in the transverse watermark zones 44. In case the web 2 is not completely severed but only weakened through compression of the watermark zone 44 the web is introduced between two driven rollers 14 which are driven by a motor 15 by means of a belt 16. In the tear-off station IV the web 2, after it has left the rollers 14, is led further to the rollers 19 which with the help of a transmission 17 are driven by a gear which imparts an intermittent speed to the rollers.

In the station IV the individual sheets 45 are severed from the web 2 in that the front part of the web is torn or pulled loose from the rest of the web, the severing taking place along the weakened watermark zone 44. The tearing off takes place so that the web is advanced by and is held tight between the rollers 14 and that the front end of the web 2 is similarly advanced and held tight between the rollers 19. To the pair of rollers 19 a rate of feed is imparted in a first phase which is less than the rate of feed of the pair of rollers 14. This means that the part of the web 2 which is between the pairs of rollers 14 and 19 is slightly slackened. In a second phase, though the rate of feed of the pair of rollers 19 is increased so that it becomes higher than the rate of feed of the pair of rollers 14 and when this happens the web is suddenly stretched, the tensile stresses in the web becoming so great that it breaks along the compressed and weakened portion which is located in the watermark zones 44. As the pair of rollers 19 continues at its higher rate of feed the sheet 45 which has been torn loose will be transported to the stack 30 of sheets before the front end of the web, which is fed forward with the help of pair of rollers 14, has time to advance to the nip between the pair of rollers 19.

The sheet 45 produced which has been treated in the above mentioned manner will have around its edge a narrow "watermark zone" and a somewhat irregular edge structure which is reminiscent of that which is found on hand-made paper.

In certain cases it is not desired to sever the individual sheets from the web 2, but to retain the web. The edge zone 41 of the web may then be provided with holes 42 adapted for a feed by means of toothed wheels. The edge zone with holes 42 can be used for toothed wheel feed in an arrangement of the type as shown in FIG. 1 but it can also be used in conjunction with printouts from automatic printers of the type used in connection with computers. If the guiding is done with the help of the toothed holes in the edge zones of the web 2, a very accurate feed of the web can be obtained and the edge zones 41 are severed in the manner as described earlier in the station II so that after passage of the clamp rollers 23 in the station III they are removed as edge clippings and be dumped into a collecting device 24.

The arrangement described here is intended only as an example of such an arrangement representing an embodiment of the invention and it is possible, for example, to use instead of the tearing wire 21 a rotating knife or a fixed (blunt) knife edge.

It is to be understood that the present invention may be embodied in other specific forms without departing from the spirit or essential characteristics of the present invention. The preferred embodiment is therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A method of manufacturing paper sheets having a width and a length, said method comprising the steps of:

watermarking a continuous web along spaced longitudinal zones and spaced transverse zones, said transverse zones intersecting said longitudinal zones, said longitudinal zones being spaced apart according to one of said width and length, said transverse zones being spaced apart according to the other of said width and length;

drying said watermarked continuous web to provide a dried continuous web;

crushing said dried continuous web along longitudinal regions within each watermarked longitudinal zone;

crushing said dried continuous web along transverse regions coextensive of and within each watermarked transverse zone; and tearing said dried continuous web along said crushed longitudinal regions and subsequently separating said dried continuous web along said crushed transverse regions so as to form individual paper sheets having watermarked borders and irregular edge structure.

2. The method in accordance with claim 1, wherein said step of breaking said dried continuous web includes passing said dried continuous web between members of two pairs of rollers arranged at a distance from one another, simultaneously driving the first pair of rollers at a constant rotational speed and driving the second pair of rollers at varying rotational speed, delivering an end of the dried continuous web from the first pair of rollers to the second pair of rollers when said second pair of rollers is at a lower rotational speed than the first pair of rollers so as to form slack in a part of the dried continuous web situated between the pairs of rollers, the rotational speed of the second pair of rollers so that the part of the dried continuous web between the said pairs of rollers is subjected to a tensile stress of such a magnitude that the crushed transverse edge region which is situated between the pairs of rollers is broken so as to produce one of said individual paper sheets, subsequently discharging said one sheet by operating the second pair of rollers at a faster rate than the rate of feed of a remaining portion of said dried continuous web by the first pair of rollers.

3. The method in accordance with claim 1, wherein said step of crushing transverse regions includes passing said paper web between a second plurality of rollers including a pressing roller having a raised portion extending axially on the pressing roller and a counterpressure roller adjacent said pressing roller.

4. The method in accordance with claim 1, wherein said step of crushing said longitudinal regions includes passing said dry continuous web between a first plurality of cooperating rollers, a member of said first plurality of cooperating rollers having riased circumferential working surfaces of a blunted vshaped cross-section.

5. The method in accordance with claim 1, wherein said tearing step includes passing said continuous web by a grooved roller while urging said dried continuous web toward the groove of the grooved roller so as to cause a tear.

6. An apparatus for the manufacture of paper sheets having a width and a length, said arrangement comprising:

means for supplying a continuous web watermarked along spaced longitudinal zones and spaced transverse zones, said transverse edge zones intersecting said longitudinal zones, said longitudinal zones being spaced apart according to one of said width and length, said transverse zones being spaced apart according to the other of said width and length;

means downstream of said supplying means for feeding the continuous web in a dry condition along a feed path;

a first plurality of cooperating rollers at a first location along said feed path and including a crushing roller having a plurality of annular raised portions circumferentially arranged around said crushing roller, said annular raised portions of said crushing roller being spaced apart from each other across said feed path by a distance substantially equal to said spacing between said longitudinal watermarked zones, said first plurality rollers adapted to continuously crush said dry continuous web along longitudinal regions with each crushed longitudinal region being within one of said watermarked longitudinal zones;

means for continuously tearing said continuous web along said crushed longitudinal regions, said tearing means at a second location along said feed path subsequent to said first location;

a second plurality of cooperating rollers at a third position along said feed path, said second plurality including a pressing roller extending across said feed path and having a raised portion extending axially on the exterior of said roller and a counterpressure roller adjacent said pressing roller, said second plurality of cooperating rollers crushing said dry continuous web along a spaced transverse region coextensive with and within each watermarked transverse zone;

means for separating said dry continuous web along said transverse crushed regions, said separating means including third and fourth pairs of rollers at a location along said feed path subsequent to said second plurality of cooperating rollers, said third and fourth pairs of rollers being spaced apart from each other, said third pair of rollers preceding said fourth pair of rollers along said feed path, means for driving said third pair of rollers at a constant rotational speed, and means for driving said fourth pair of rollers alternatingly between a first rotational speed which is less than said constant rotational speed and a second rotational speed greater than said constant rotational speed.

7. The apparatus in accordance with claim 6, wherein said tearing means includes a circumferentially grooved roller and a stationary blunt member extending through the circumferential groove of the grooved roller.

8. The apparatus in accordance with claim 6, wherein each raised portion of said crushing roller includes a convex working surface.

9. The apparatus in accordance with claim 8, wherein said convex working surface has a blunted v-shaped cross-section.

* * * * *